US005861709A

United States Patent [19]

Löbl et al.

[11] Patent Number: 5,861,709

[45] Date of Patent: Jan. 19, 1999

[54] THIN-PANEL PICTURE DISPLAY DEVICE

[75] Inventors: Hans-Peter Löbl, Monschau, Germany; Maria Huppertz, Hauset, Belgium; Gerke T. Jaarsma, Eindhoven, Netherlands

[73] Assignee: U.S. Philips Corporation, New York, N.Y.

[21] Appl. No.: 775,902

[22] Filed: Jan. 2, 1997

[30] Foreign Application Priority Data

Jan. 15, 1996 [EP] European Pat. Off. ..... 96200092

[51] Int. Cl.[6] ..... H01J 29/70; H01J 1/62; G09G 3/10

[52] U.S. Cl. ..... 313/422; 313/103 CM; 313/105 CM; 313/495; 315/169.1

[58] Field of Search ..... 313/422, 495, 313/496, 497, 103 CM, 105 CM, 103 R, 105 R, 106, 107; 315/169.1

[56] References Cited

U.S. PATENT DOCUMENTS 5,313,136 5/1994 Van Gorkom ..... 313/422
5,557,296 9/1996 Lambert ..... 313/422
5,614,781 3/1997 Spindt et al. ..... 313/422
5,721,468 2/1998 De Zwart et al. ..... 313/422

FOREIGN PATENT DOCUMENTS

0464937A1 1/1992 European Pat. Off. ..... H01J 31/12
96/02933 2/1996 WIPO ..... H01J 29/80

*Primary Examiner*—Nimeshkumar Patel
*Assistant Examiner*—Geraldine G. Hopkins
*Attorney, Agent, or Firm*—Robert J. Kraus

[57] ABSTRACT

A picture display device having a vacuum envelope which is provided with a transparent face plate and a display screen having a pattern of luminescent pixels, and with a rear wall, comprising electron-producing means, an addressing system arranged between said means and the face plate so as to address desired pixels, and, adjacent to the display screen, a plate of electrically insulating material provided with apertures for passing electrons, in operation a voltage difference being applied across said plate, characterized in that the surface at the electron entrance side of the apertured plate is coated with a coating of a material selected from the group comprising nonstoichiometric nitrides, borides and carbides of Al and/or Si, and amorphous Si.

5 Claims, 4 Drawing Sheets

THIN-PANEL PICTURE DISPLAY DEVICE

BACKGROUND OF THE INVENTION

The invention relates to a picture display device having a vacuum envelope which is provided with a transparent face plate and a display screen having a pattern of luminescent pixels, and with a rear wall, comprising electron-producing means, an addressing system arranged between said means and the face plate so as to address desired pixels, and, adjacent to the display screen, a plate of electrically insulating material provided with apertures for passing electrons.

The display device described above is of the thin-panel type. Display devices of the thin-panel type are devices having a transparent face plate and, arranged at a small distance therefrom, a rear plate, while a (for example, hexagonal) pattern of phosphor dots is provided on the inner surface of a face plate. If (video information-controlled) electrons impinge upon the luminescent screen, a visual image is formed which is visible via the front side of the face plate. The face plate may be flat or, if desired, curved (for example spherical or cylindrical).

A thin-panel display device described in U.S. Pat. No. 5,313,136 (=PHN 12.927) comprises a plurality of juxtaposed sources for emitting electrons, local electron propagation means cooperating with the sources, each having a wall of a high-ohmic, electrically substantially insulating material having a secondary emission coefficient which is suitable for propagating emitted electrons, and an addressing system comprising electrodes (selection electrodes) which can be driven row by row so as to extract electrons from the propagation means at predetermined extraction locations facing the luminescent screen, while further means are provided for directing extracted electrons towards pixels of the luminescent screen for producing a picture composed of pixels.

Other display devices of the thin-panel type to which the invention pertains are, for example, plasma displays and, in particular, field emission displays.

The luminescent screen is also referred to as the phosphor screen. An important component of the above-mentioned display device is an apertured plate of electrically insulating material, in many applications described as "the screen spacer".

The screen spacer is adjacent to the phosphor screen. Due to the efficiency and the saturation behaviour of the phosphor, it is of crucial importance that the acceleration voltage to the phosphor screen is as high as possible. Dependent on the phosphors used, 3 kV or, more frequently, 4 to 5 kV is a minimum requirement.

The screen spacer is made of an insulating material, particularly glass. The face plate is provided with a low-ohmic transparent conducting electrode of, for example ITO. This coating is provided with the phosphor screen and (possibly) a black matrix. A typical thickness of the screen spacer is 0.3 or 0.4 to 1.0 mm. The voltage difference between the input side of the screen spacer and the ITO coating should be as high as possible. At large voltage differences a number of unwanted effects in the form of picture errors may occur. The invention is based on the recognition that these effects are related to the "vacuum current" flowing through the screen spacer. The invention provides a display device of the type described in the opening paragraph, having surfaces, particularly at the electron entrance side of the screen spacer, treated in such a way that the occurrence of these unwanted effects (which, according to the invention, are based on secondary emission of electrons backscattered from the display screen at voltage differences of at least 5 kV across the spacer) are obviated entirely or partly. For this purpose, a coating is preferably used which has such a composition that its properties are stable under electron bombardment. This contributes to the lifetime.

To this end, an embodiment of a display device of the type described in the opening paragraph is characterized in that the surface at the entrance side of the apertured plate is coated with a coating of a material selected from the group comprising nonstoichiometric nitrides, borides and carbides of Al and/or Si, and amorphous Si, optionally doped with N and/or H.

It has been found that with the above coatings, which were found to be stable under electron bombardment, electrical resistances between $10^{10}$ Ω/□ and $10^{14}$ Ω/□ can be realized, which values are eminently suitable for the purpose of the invention, values between $10^{10}$ Ω/□ and $10^{13}$ Ω/□, and in particular $10^{11}$ to $10^{12}$ Ω/□, being preferred. Of the above materials $SiN_x$ ($0<x\leqq1.3$) is very well suited for an industrial process. Suitable resistance values are obtained in particular if $0<x\leqq0.4$.

It appears that at higher acceleration voltages, the unwanted effects leading to picture errors can effectively be prevented when these coatings are used. Further the resistance of the material of the apertured plate should be sufficiently high. This resistance R (in Ω cm) preferably satisfies $\log R\geqq12$.

The required coatings may be provided by means of plasma CVD or, preferably, (rf or dc) magnetron sputtering. Generally, the surface of the plate and the walls of the apertures are coated therewith, while leaving the choice of coating at one or two sides.

These and other aspects of the invention will be apparent from and elucidated with reference to the embodiments described hereinafter.

In the drawings:

BRIEF DESCRIPTION OF THE DRAWINGS

FIG. 1A shows an enlarged detail of FIG. 1;

Identical components are denoted by the same reference numerals.

DESCRIPTION OF THE PREFERRED EMBODIMENTS

Figure 1:
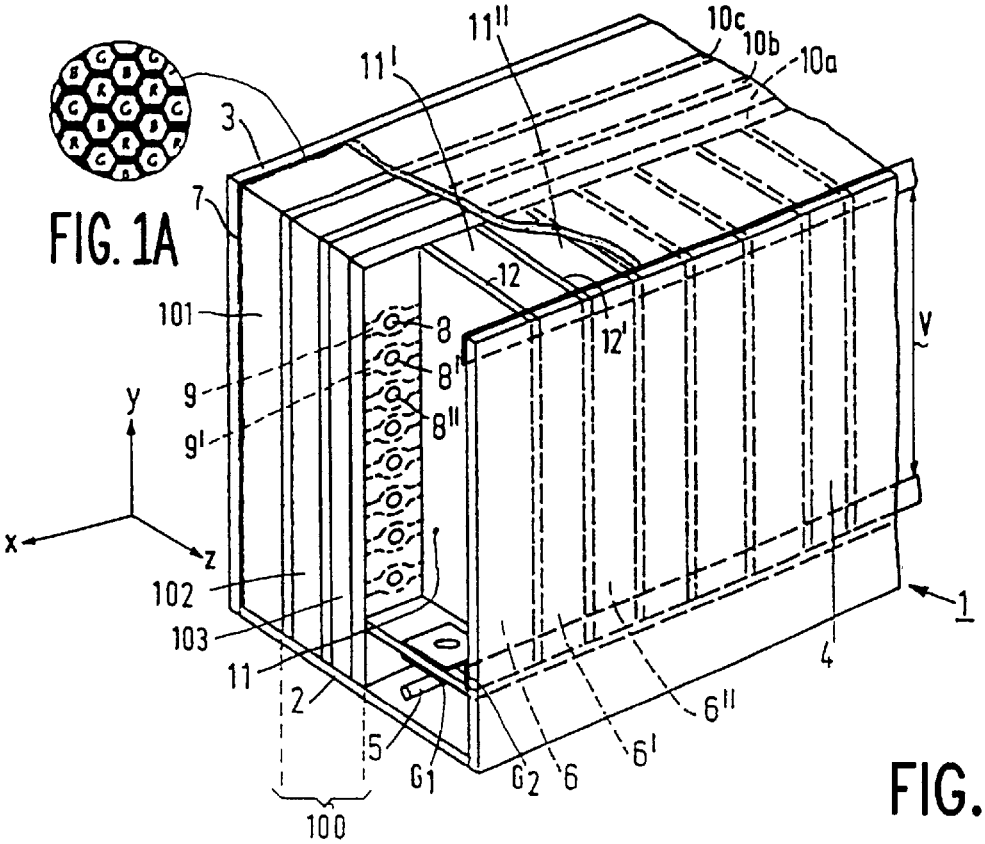
FIG. 1 is a diagrammatic perspective elevational view, partly broken away, of a part of a (colour) display device with electron propagation ducts, an addressing system with an apertured preselection plate, an apertured fine-selection plate and a screen spacer whose components are not shown to scale.

FIG. 1 shows a thin-panel picture display device of the type described in EP-A 464937 having a display panel (window) 3 and a rear wall 4 located opposite said panel. A display screen 7 having a (for example, hexagonal) pattern of red (R), green (G) and blue (B) luminescing phosphor pixels is arranged on the inner surface of window 3. In the embodiment shown triplets of phosphor elements are arranged in tracks transverse to the long axis of the display screen (i.e. "vertically staggered", see inset) but the invention is not limited thereto. For example, a horizontally staggered arrangement is also possible.

An electron source arrangement 5, for example a line cathode which by means of electrodes provides a large number of electron emitters, for example 600, or a similar number of separate emitters, is arranged proximate to a wall 2 which interconnects panel 3 and rear wall 4. Each of these emitters is to provide a relatively small current so that many types of cathodes (cold or hot cathodes) are suitable as emitters. The emitters may be driven by a video drive circuit. The electron source arrangement 5 is arranged opposite entrance apertures of a row of electron propagation ducts extending substantially parallel to the screen, which ducts are constituted by compartments 6, 6', 6", . . . etc., in this case one compartment for each electron source. These compartments have cavities 11, 11', 11", . . . defined by the rear wall 4 and partitions 12, 12', . . . The cavities 11, 11', . . . may alternatively be provided in the rear wall 4 itself. At least one wall (preferably the rear wall) of each compartment should have a high electrical resistance in at least the propagation direction, which resistance is suitable for the purpose of the invention, and have a secondary emission coefficient $\delta>1$ over a given range of primary electron energies (suitable materials are, for example, ceramic material, glass, synthetic material—coated or uncoated). An axial propagation field is generated in the compartments by applying a potential difference $V_P$ across the height of the compartments 6, 6', 6", . . .

The electrical resistance of the wall material has such a value that a minimum possible total amount of current (preferably less than, for example 10 mA) will flow in the walls at a field strength in the axial direction in the compartments of the order of one hundred to several hundred volts per cm required for the electron propagation. By applying a voltage of the order of several dozen to several hundred volts (value of the voltage is dependent on circumstances) between the row 5 of electron sources and the compartments 6, 6', 6", electrons are accelerated from the electron sources towards the compartments, whereafter they impinge upon the walls in the compartments and generate secondary electrons.

Figure 2:
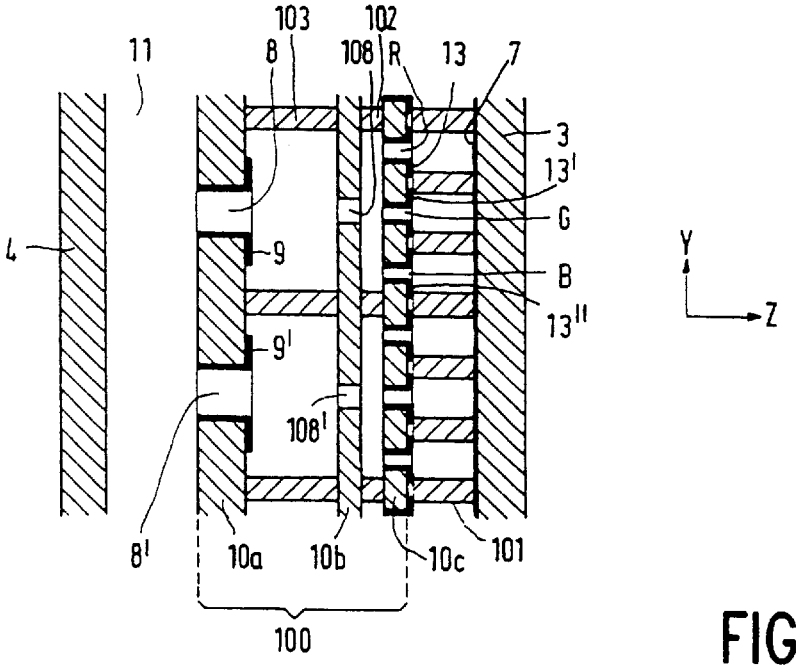
FIG. 2 is a diagrammatic cross-section through a part of a device of the type shown in FIG. 1.
Figure 3:
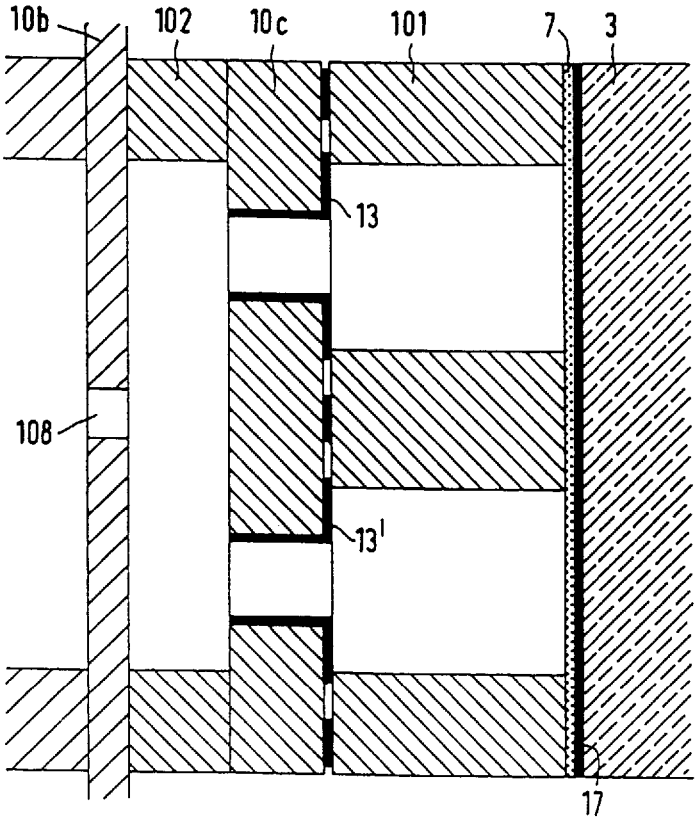
FIG. 3 shows an enlarged detail of FIG. 2.
Figure 4:
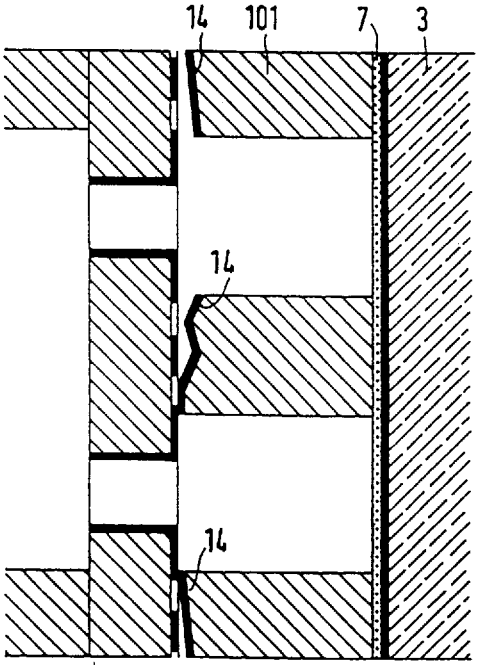
FIG. 4 is a cross-sectional view of an embodiment of a screen spacer.

The space between the compartments and the luminescent screen 7, which is arranged on the inner wall of panel 3, accommodates in this case a (stepped) addressing system 100 which comprises an (active) preselection plate 10*a*, a (passive) obstruction plate 10*b* and an (active) (fine-) selection plate 10*c* (see also FIG. 2). Structure 100 is separated from the luminescent screen 7 by a screen spacer 101 formed as an apertured plate of electrically insulating material.

FIG. 2 shows in a diagrammatical cross-section a part of the display device of FIG. 1 in greater detail, particularly the addressing structure 100 comprising preselection plate 10*a* with apertures 8, 8', 8", . . . , and fine-selection plate 10*c* with groups of apertures R, G, B. Three fine-selection apertures R, G, B are associated with each preselection aperture 8, 8', etc. in this case. In the diagrammatic FIG. 2, the apertures R, G, B are coplanar. However, in reality they are arranged in a configuration corresponding to the phosphor dot pattern (see FIG. 1). In this case, an apertured obstruction plate 10*b* having apertures 108, 108", . . . is arranged between the preselection plate 10*a* and the fine-selection plate 10*c*, which obstruction plate prevents electrons from the propagation ducts 11 from impinging upon the display screen straight through a fine-selection aperture (known as unwanted "direct hits").

Electron propagation ducts 6 with transport cavities 11, 11', . . . are formed between the structure 100 and rear wall 4. To be able to extract electrons from the ducts 6 via the apertures 8, 8', . . . , addressable, metal preselection electrodes 9, 9', etc. extending from aperture to aperture and surrounding the apertures are arranged in ("horizontal") rows parallel to the long axis of the display screen on, for example the display screen side of the plate 10*a*.

The walls of the apertures 8, 8', . . . may be metallized.

Similarly as the plate 10*a*, the fine-selection plate 10*c* is provided with "horizontally oriented" addressable rows of (fine-)selection electrodes for realising fine selection. The possibility of directly or capacitively interconnecting corresponding rows of fine-selection electrodes is important in this respect. In fact, a preselection has already taken place and, in principle, electrons cannot land at the wrong location. This means that only one group, or a small number of groups of three separately formed fine-selection electrodes is required for this mode of fine selection.

The preselection electrodes 9, 9', . . . are subjected to a linearly increasing DC voltage, for example by connecting them to a voltage divider. The voltage divider is connected to a voltage source in such a way that the correct potential distribution to realise electron transport in the ducts is produced across the length of the propagation ducts. Driving is effected, for example by applying a pulse (of, for example 250 V) for a short period of time to consecutive preselection electrodes and to apply shorter lasting pulses of, for example 200 V to the desired fine-selection electrodes. It should of course be ensured that the line selection pulses are synchronized with the video information. The video information is applied, for example to the individual $G_1$ electrodes which drive the emitters (FIG. 1), for example in the form of a time or amplitude-modulated signal.

It should be noted that several variants of the construction comprising the obstruction plate 10*b* as shown in FIG. 2 are possible. For example, the plate 10*b* may be combined to one unit with one or both spacer plates 102, 103 at both sides. In this case, the spacer plate 103 is referred to as the coarse-selection spacer and spacer plate 102 is referred to as the obstruction plate spacer or "chicane" spacer.

Figure 5:
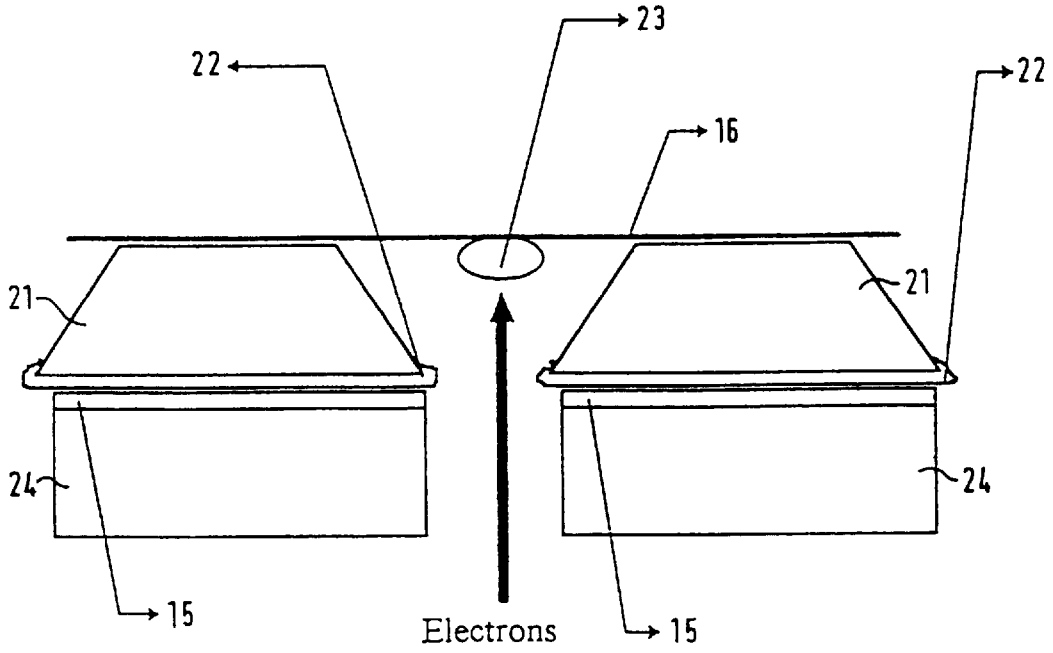
FIG. 5 shows diagrammatically a screen part of a flat display.

In a flat panel display or a flat CRT of the above type an acceleration voltage of several kV is applied between the color selection electrode (15) and the phosphor screen (16) (FIG. 5). This voltage is applied across the spacer (21) between the metallization (15) and the phosphor screen (16) which is coated e.g. with a transparent conductive layer such as ITO. The spacer (21) is made of glass and has a pattern of holes corresponding to the phosphor pixels. Electrons are accelerated towards the phosphor screen (16) and hit the phosphor (23) which emits light. In order to avoid charging of the surface of the spacer by backscattered electrons and thus electrical breakdown, the spacer (21) has to be coated by a electrical conductive coating (22) which has a resistance between $10^{10}$ and $10^{14}$ Ω/□.

Since the "high R" coating is essential for the high voltage performance of the display, in the following the emphasis is mainly on the physical properties of nonstoichiometric silicon nitride $SiN_x$ films which are used for this purpose. A practical requirement for this coating is a sheet resistance of $10^{11}$ Ω/□ after annealing in air at 450° C.

It was found that $SiN_x$ ($0<x\leqq 1.3$) films are structurally stable upon annealing in air up to about 600° C. At temperatures above 600° C. partial oxidation of the silicon nitride takes place and above 825° C. crystalline silicon is found in the samples. The electrical sheet resistance of $SiN_x$ films depends on the nitrogen stoichiometry x and can be varied between $10^7$ Ω/□ and more than $10^{15}$ Ω/□. Upon annealing at temperatures below 600° C. the electrical resistance increases to a value between $10^9$ Ω/□ and more than $10^{15}$ Ω/□ depending on the stoichiometry x of the films. Thus a value of $10^{11}$ Ω/58 after annealing in air at 450° C. can be achieved very easily. At annealing temperatures above about 750° C. the electrical resistance decreases due to the beginning crystallization of Si. The electrical resistance of films with a given stoichiometry x is thus determined by the annealing temperature. The atmosphere in which the annealing takes place is of minor importance, a fact which is important for production.

Compared to other suited nonstoichiometric nitride coatings such as $AlN_x$ or $(Al:Si)N_x$ ($0<x\leqq 1$), $SiN_x$ has the advantage that R is not very sensitive to variations of the nitrogen content x. Thus industrial production of these $SiN_x$ layers can in particular be done very easily.

The function of the coating can be improved by an additional coating such as stoichiometric $Si_3N_4$, or AlN, or (Al:Si)N which has a low secondary electron emission ($\delta_{max}<4$), is stable against electron bombardment, and which protects the glass surface of the holes in the spacer against degradation (coating B and C). The coating configurations which are shown in FIG. 6 were found to result in good stability against electrical breakdown.

Figure 6A:
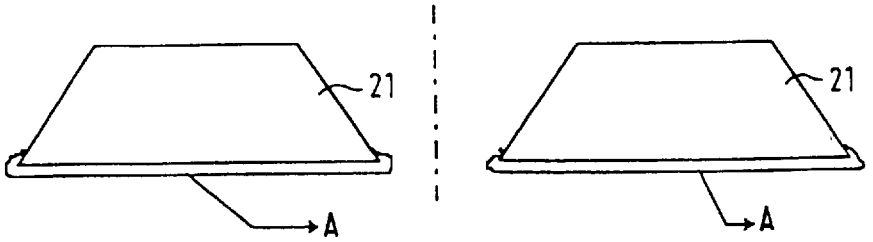
FIGS. 6A, B and C show coating configurations.
Figure 6B:
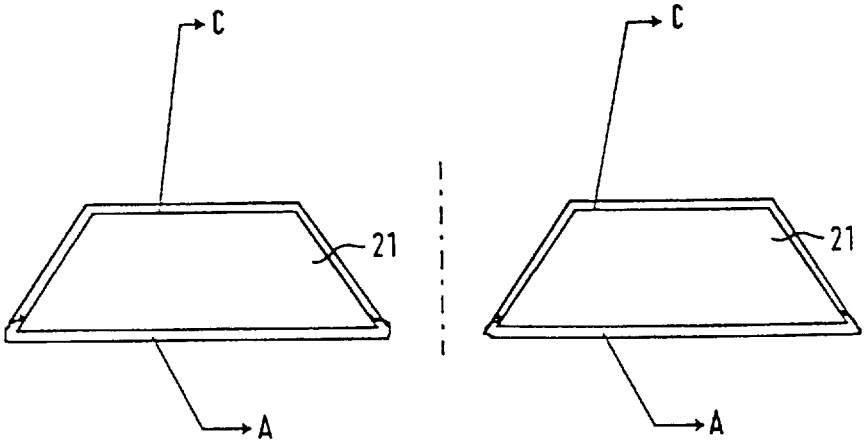

FIGS. 6A, B, C show schematic drawings of the coated spacer.

21=spacer, A–C=coatings.

Material A is preferentially $SiN_x$ with $0\leqq x\leqq 1.3$.

Material B is preferentially $Si_3N_4$.

Material C is preferentially $Si_3N_4$.

Figure 6C:
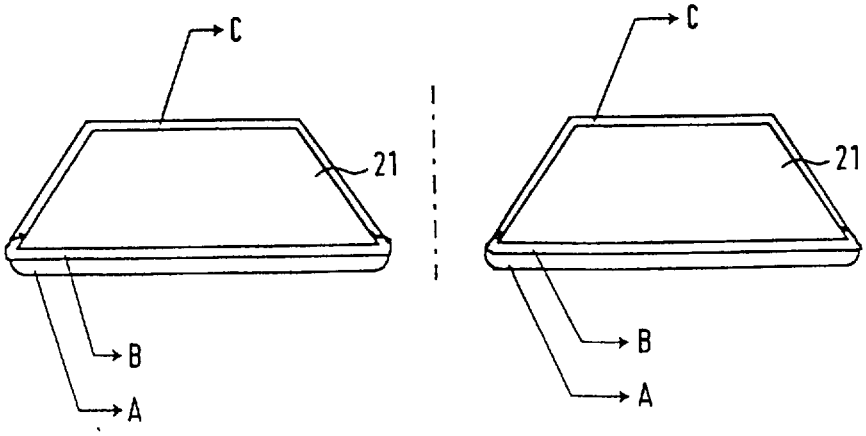

Materials A and B in FIG. 6C can also be interchanged.

The electrical resistance of coating A is between $10^{10}$ and $10^{14}$ Ω/□, the electrical resistance of B and C is higher than $10^{14}$ Ω/□, and in particular higher than $10^{15}$ Ω/□. $SiN_x$ (material A) can also be replaced by $AlN_x$, or by $(Al:Si)N_x$. Materials B and C can be either $Si_3N_4$, or AlN, or (Al:Si)N. The thickness of the material A is between 5 and 500 nm preferably at least 100 nm, in particular substantially 200 nm, the thickness of material B and C between 5 and 1000 nm, preferably at least 100 nm, in particular substantialy 500 nm. All the above mentioned materials can be deposited by reactive magnetron sputtering on a large area.

The preferred material combination is $SiN_x$ (material A) and $Si_3N_4$ (material B and C). The voltage which could be applied over a coated glass spacer of 0.42 mm thickness is reproducibly higher than 5 kV. The coating was such as described in FIG. 6C (coatings B, C=500 nm $Si_3N_4$; coating A=200 nm $SiN_x$, $x\cong 0.33$). A coating as shown in FIG. 6C was tested also for x=0 (α- Si) and gave similar results. Also the version shown in FIG. 6B was tested (coating C=500 nm $Si_3N_4$, coating A=200 mm $SiN_x$; $x\cong 0.18$) and gave a comparable good result (voltage>5 Kv over the coated glass spaces).

Figure 7:
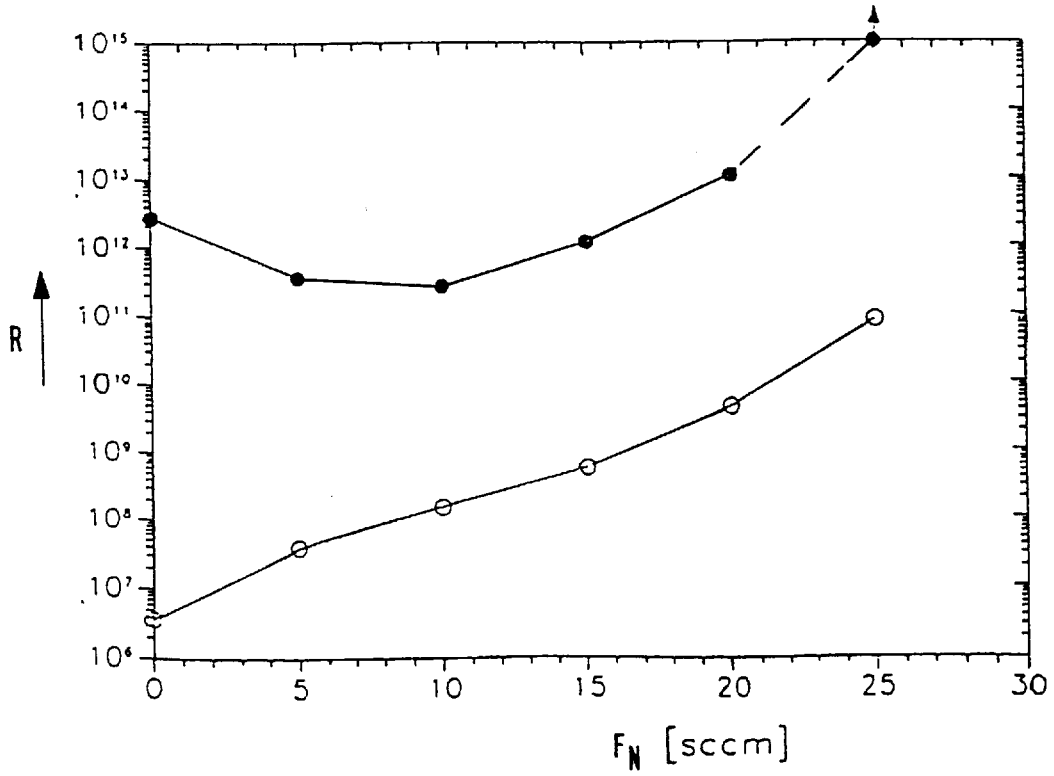
FIG. 7 shows the electrical resistance of $SiN_x$ as a function of the nitrogen flow during deposition.

The material system $SiN_x$ and $Si_3N_4$ has the following advantages:

1. A resistance of about $10^{11}$ Ω/□ of the $SiN_x$ film (material A) is achieved after assembling of the tube (frit baking at 450° C. in air and in vacuum). The resistance depends mainly on the frit baking temperature in air and is relative insensitive on the nitrogen flow during reactive sputtering of the film (FIG. 7).

2. $SiN_x$ is advantageous compared with oxides (mentioned in EP-A 580.244), because annealing in vacuum at temperatures up to 450° C., as it is done during tube assembling, does not lead to reduction of the film and thus not to a change in electrical resistivity.

3. Both coatings $SiN_x$ (Coating A) and $Si_3N_4$ (Coating B and C) can be made in the same reactive sputter deposition process just by changing the amount of nitrogen in the sputtering gas.

The invention can be used wherever a high voltage of several kV has to be applied across a structured glass plate as it is the case in CRT-type flat panel displays, like the Zeus display and the field emission display.

FIG. 7 shows the electrical resistance R (in Ω/□) of 200 nm thick $SiN_x$ films as function of the nitrogen flow $F_N$ (in standard cubic centimetres per minute) during sputtering. Open symbols stand for as desposited films, full symbols for films annealed at 450° C. in air. $F_N$=10 sccm approximately corresponds with x=0.3, $F_N$=15 sccm with x=0.4 and $F_N$=20 sccm with x=0.55.

We claim:

1. A picture display device having a vacuum envelope which is provided with a transparent face plate and a display screen having a pattern of luminescent pixels, and with a rear wall, comprising electron-producing means, an addressing system arranged between said means and the face plate so as to address desired pixels, and, adjacent to the display screen, a spacer plate of electrically insulating material provided with apertures for passing electrons, in operation a voltage difference being applied across said spacer plate, characterized in that the surface at the electron entrance side of the apertured spacer plate is coated with a coating of a material selected from the group comprising nonstoichiometric nitrides, borides and carbides of Al and/or Si, and amorphous Si.

2. A picture display device as claimed in claim 1, characterized in that the coating has a resistance in the range from $10^{10}$ to $10^{14}$ Ω/□.

3. A picture display device as claimed in claim 1, characterized in that the coating has a resistance in the range from $10^{11}$ to $10^{12}$ Ω/□.

4. A picture display device as claimed in claim 1, characterized in that the coating comprises $SiN_x$ ($0<x\leqq 1.3$).

5. A picture display device as claimed in claim 1, characterized in that the apertures in the spacer plate are defined by walls covered with $Si_3N_4$.

* * * * *